US005653094A

United States Patent [19]

Kivits et al.

[11] Patent Number: 5,653,094

[45] Date of Patent: Aug. 5, 1997

[54] METHOD FOR THE MUTUAL REPOSITIONING OF PRODUCTS, FOR INSTANCE FOR ADJUSTING THE MUTAL POSITION OF GRAPHIC PRODUCTS IN A PACKING APPARATUS, AND A FEEDING APPARATUS FOR APPLYING THAT METHOD

[75] Inventors: Petrus Franciscus Kivits, Schiedam; Ronald Timmerman, Zaanstad, both of Netherlands

[73] Assignee: Buhrs-Zaandam B.V., Zaandam, Netherlands

[21] Appl. No.: 451,061

[22] Filed: May 25, 1995

[30] Foreign Application Priority Data

May 31, 1994 [NL] Netherlands ..... 9400890

[51] Int. Cl.[6] ..... B65B 11/08; B65B 35/24

[52] U.S. Cl. ..... 53/461; 53/55; 53/504

[58] Field of Search ..... 53/55, 504, 461, 53/251, 228, 229, 230; 198/460.1, 461.1, 459.8, 459.1

[56] References Cited

U.S. PATENT DOCUMENTS

| | | | |
|---|---|---|---|
| 3,664,522 | 5/1972 | Goto . | |
| 4,430,606 | 2/1984 | Otsuki et al. | 318/601 |
| 4,738,078 | 4/1988 | Benz et al. . | |
| 5,004,094 | 4/1991 | Brandt | 198/460.1 |
| 5,097,939 | 3/1992 | Shanklin et al. | 198/460.1 X |
| 5,189,864 | 3/1993 | Cinotti et al. | 53/228 X |

FOREIGN PATENT DOCUMENTS

| | | |
|---|---|---|
| 0282112 | 9/1988 | European Pat. Off. . |
| 4307934 | 9/1993 | Germany . |

*Primary Examiner*—James F. Coan

*Attorney, Agent, or Firm*—Griffin, Butler, Whisenhunt & Kurtossy

[57] ABSTRACT

A method and apparatus for the mutual repositioning of products (4), which products are fed at a specific speed and with a specific distance in between, and the mutual position of the products (4) being changed by means of speed influencing means (2, 3), while for the mutual repositioning of products (4) consisting of several layers, for adjusting the mutual position of graphic products in a packing apparatus, a speed influencing means (2, 3) is brought into engagement with the product both at the top side and at the bottom side of the product (4), which two speed influencing means (2, 3) are always driven at the same speed relative to each other.

10 Claims, 2 Drawing Sheets

METHOD FOR THE MUTUAL REPOSITIONING OF PRODUCTS, FOR INSTANCE FOR ADJUSTING THE MUTAL POSITION OF GRAPHIC PRODUCTS IN A PACKING APPARATUS, AND A FEEDING APPARATUS FOR APPLYING THAT METHOD

The invention relates to a method for the mutual repositioning of products, which products are fed at a specific speed and with a specific distance in between, the mutual position of the products being changed by means of speed influencing means.

Such a method is known from U.S. Pat. No. 4,430,606. This patent describes a method for the accelerated feed of a separate sheet of paper, wherein, during feeding, the position and speed of this sheet of paper are accurately regulated. A sheet of paper is passed over a speed influencing means or drive roller, which accelerates the sheet of paper. Because only single, separate sheets are fed, only one drive roller may suffice and only a pressure roller or follow-on roller engages with the reverse side of the paper. Consequently, this method is not suitable for feeding products consisting of several layers, for instance folded printed matter or stacked products.

The object of the invention is to provide a method for the mutual repositioning of products consisting of several layers and/or stacked products.

To that end, the method according to the invention exhibits the characteristic that for the mutual repositioning of products consisting of several layers, for instance for adjusting the mutual position of graphic products in a packing apparatus, a speed influencing means is brought into engagement with the product both at the top side and at the bottom side of the product, which two speed influencing means are always driven at the same speed relative to each other.

This also enables products consisting of several layers, such as folded or stacked products, to be repositioned in a packing apparatus. In this manner, the products are for instance placed on a packing material band with an accurately settable distance in between. Subsequently, the packing material band is folded around the products and the folded parts are attached to each other in the direction of travel. Transversely to the direction of travel, the packing material band between the products is also secured and cut through to obtain separately packed products. This does not involve any waste of packing material in the direction of travel.

The method according to the invention is further characterized in that the distance between the two speed influencing means is infinitely variable, without changing the speed of the speed influencing means relative to each other and without introducing a phase shift between the speed influencing means. As a result, the successive products fed to a packing apparatus can have different thicknesses and can still be placed on a material packing band so as to be accurately repositioned relative to each other.

In addition, stacked products having different dimensions, viewed in the direction of travel, can also be repositioned. The smallest product normally lies on top and when the speed influencing means are being passed by the smallest product (lying on top of the stack) the repositioning takes place.

A particularly advantageous method according to the invention is characterized in that the products are fed by means of a feed conveyor at a specific speed $v_1$; the speed of the speed influencing means is brought to the same speed $v_1$ as that of the products fed on the feed conveyor; a product is fed by the feed conveyor between the speed influencing means; the product is released by the feed conveyor; whereupon the product is decelerated or accelerated by the speed influencing means to a desired speed $v_2$ of the packing apparatus; the product is simultaneously positioned relative to a packing material band; and the product is released by the speed influencing means. In this manner, the method can readily be applied in a packing apparatus.

A particularly advantageous method according to the invention is characterized in that, after the product is released by the feed conveyor, the position of the product relative to the speed influencing means is detected. This permits products to be repositioned while the dimensions of the successive products, viewed in the direction of travel, is variable. These products can be repositioned relative to each other so that, viewed in the direction of travel, no loss of packing material is caused.

The invention also relates to a feeding apparatus for the mutual repositioning of products which comprises at least one speed influencing means, a transmission and a variable-speed motor.

Such a feeding apparatus is known from U.S. Pat. No. 4,430,606. This patent describes a feeding apparatus for the accelerated feed of a separate sheet of paper, wherein, during feeding, the position and speed of this sheet of paper are accurately controlled. A sheet of paper is passed over a speed influencing means or drive roller, which accelerates the sheet of paper. Because only single, separate sheets are fed, only one drive roller may suffice. Only a pressure roller or follow-on roller engages with the reverse side of the paper. Hence, this feeding apparatus is not suitable for feeding products consisting of several layers, for instance folded printed matter or stacked products.

The object of the invention is to provide a feeding apparatus for the mutual repositioning of products consisting of several layers and/or stacked products.

To that end, the feeding apparatus according to the invention exhibits the characteristic that for the mutual repositioning of products consisting of several layers, for instance for adjusting the mutual position of graphic products in a packing apparatus, a speed influencing means can be brought into engagement with the product both at the top side and at the bottom side of the product, the two speed influencing means always having the same speed relative to each other.

This also enables products consisting of several layers, such as folded or stacked products, to be repositioned in a packing apparatus. With such an apparatus, the products can for instance be placed on a packing material band with an accurately settable distance in between, so that no packing material is wasted in the direction of travel.

The feeding apparatus according to the invention is further characterized in that the distance between the two speed influencing means is infinitely variable, without changing the speed of the speed influencing means relative to each other and without involving a phase shift between the speed influencing means. As a result, the successive products fed to a packing apparatus can have different thicknesses and can still be placed on a material packing band so as to be accurately repositioned relative to each other.

In addition, stacked products having different dimensions, viewed in the direction of travel, can also be repositioned. The smallest product normally lies on top and when the speed influencing means are being passed by the smallest product (lying on top of the stack) the repositioning takes place.

The invention is moreover characterized by a feeding apparatus comprising speed influencing means in the form of feed rollers, and comprising one motor which drives two fixed shafts via a transmission, while one feed roller is directly mounted on one shaft and the other feed roller is connected, via a coupling, with the other shaft, the motor driving the two fixed drive shafts via a toothed belt toothed on both sides. Because the motor drives the two feed rollers simultaneously via the fixed shafts, the mutual distance between the two feed rollers can be changed by means of the coupling without changing the speed of the feed rollers or involving a phase shift between the feed rollers. The coupling applied for this purpose is known per se.

An advantageous embodiment of the feeding apparatus according to the invention is characterized in that the feeding apparatus comprises a detecting means detecting the position of the product to be positioned relative to the feed rollers. This enables products to be repositioned while the dimensions of the successive products, viewed in the direction of travel, are variable. These products can be positioned relative to each other, as a result of which, viewed in the direction of travel, no loss of packing material is caused.

The method according to the invention and an exemplary embodiment of a feeding apparatus according to the invention will be further explained hereinafter with reference to the accompanying drawings. In these drawings.

Figure 1:
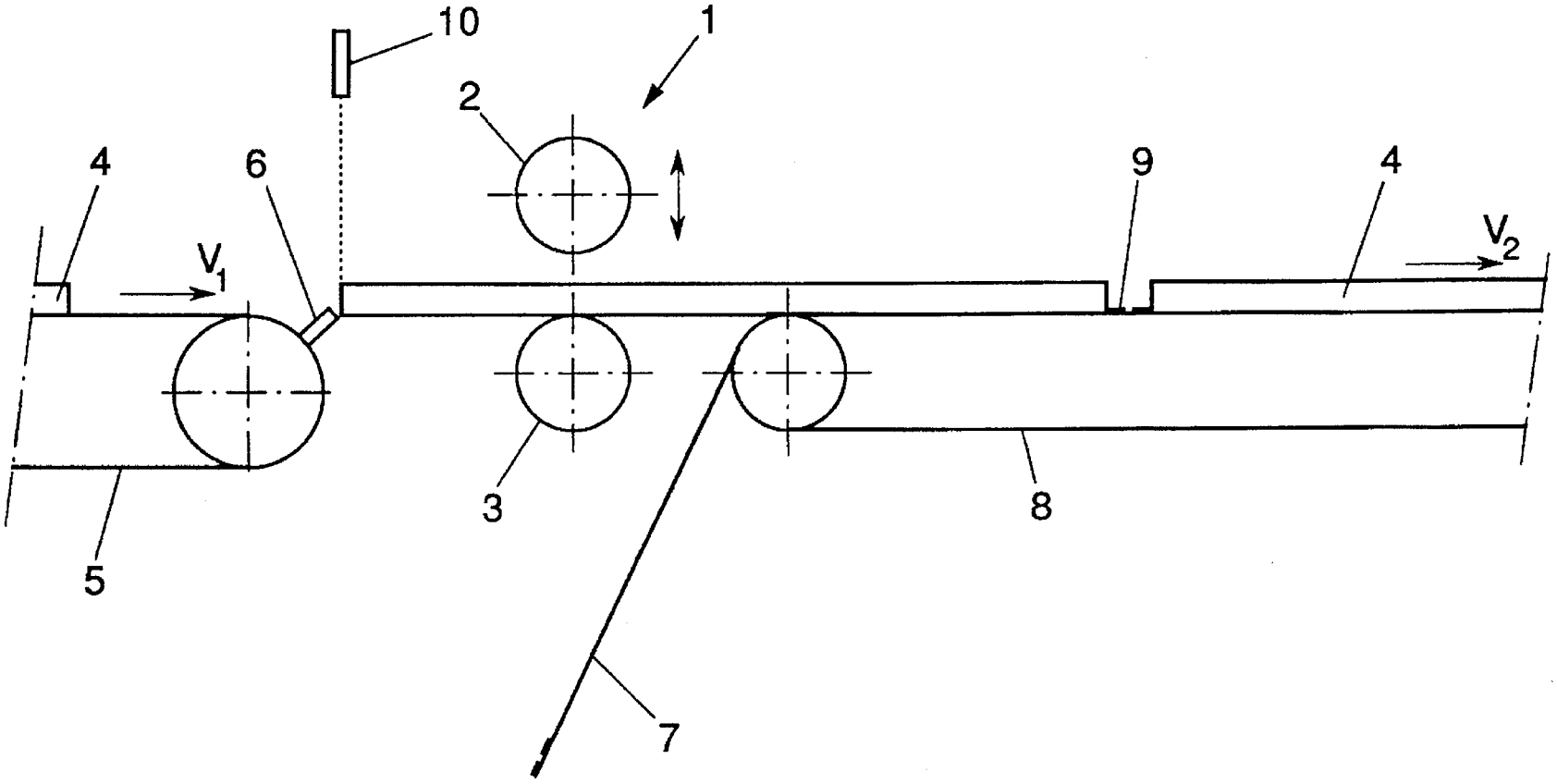
FIG. 1 is a side elevation of a schematic arrangement of a feeding apparatus according to the invention in a packing apparatus.

FIG. 1 shows a possible schematic arrangement of a feeding apparatus 1 according to the invention. Here, the speed influencing means are shown in the form of two feed rollers 2,3. The products 4 the speed of which should be varied are fed to the feeding apparatus 1 by a feed conveyor 5 comprising carriers 6. After the speed has been varied and a product 4 has been positioned, this product 4 is disposed on a packing material band 7 by the feeding apparatus. This packing material band 7 is supported by a conveyor 8. If the packing material band 7 is made of paper, it is already provided, transversely to the direction of travel and in a manner known per se, with adhesive strips, see for instance European patent application 0 526 944.

The products 4 are positioned on the packing material band 7 by the feeding apparatus 1 in such a manner that the distance between two products 4 to be packed is minimal.

Figure 3:
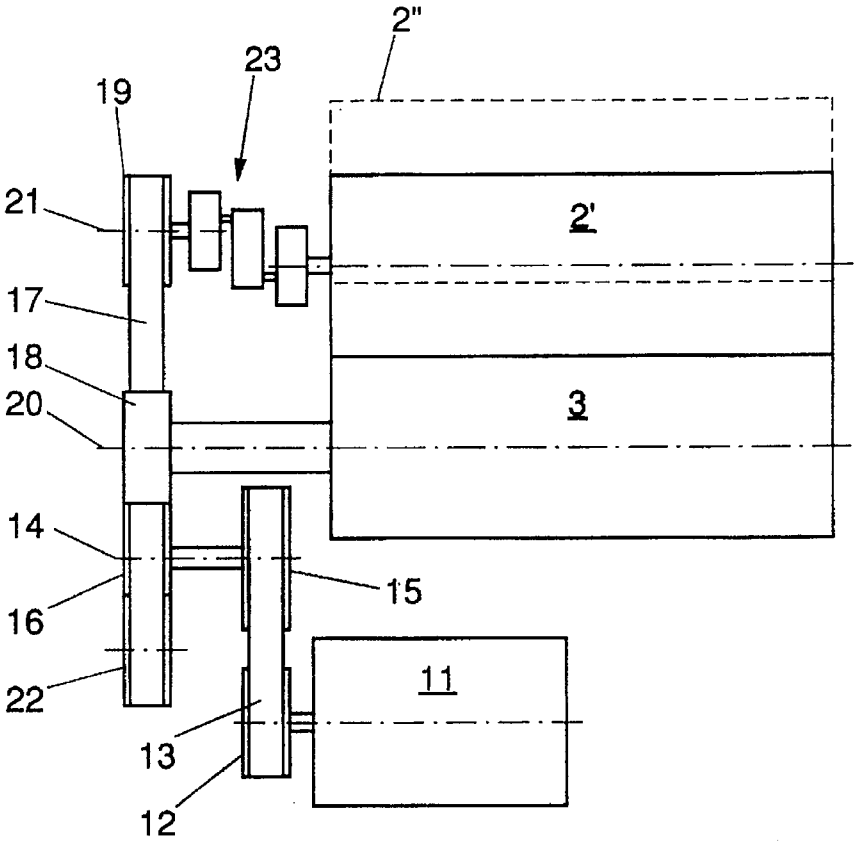
FIG. 3 is a view according to the arrow A in FIG. 2.
Figure 2:
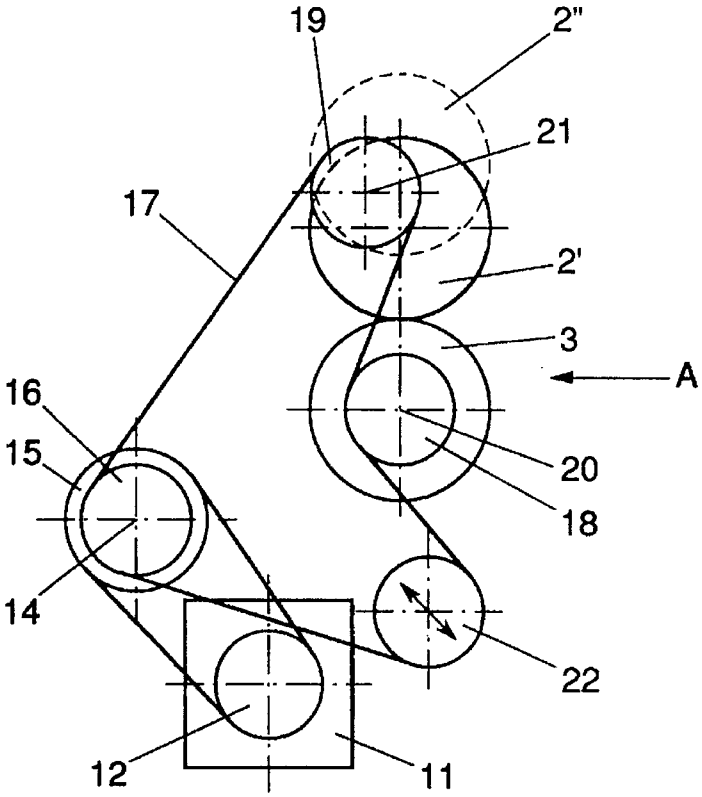
FIG. 2 is a side elevation of the driving gear and transmission of the feed rollers.

FIG. 2 is a side elevation of the driving gear and the transmission of the feed rollers 2,3. As is also visible in FIG. 3, the upper feed roller 2 is vertically movable between a minimum position 2', with the distance between the feed rollers being zero, and a position 2", with the distance between the feed rollers being maximal. The driven shaft of a motor 11 is provided with a pulley 12 and drives, via a toothed belt 13, an intermediate shaft 14, which shaft is provided with two pulleys 15,16. Via the pulley 16 and a belt 17 toothed on both sides, the intermediate shaft 14 is coupled to two pulleys 18,19 mounted on two fixed shafts 20,21. To cause the toothed belt 17 to run round the toothed disc 18 through a sufficiently large angle, an adjustable tensioner 22 is provided under the fixed shaft 20.

The lower feed roller 3 is mounted directly on the lower fixed shaft 20. Via a coupling 23 (see FIG. 3), such as for instance a Schmidt coupling, known per se, the upper feed roller 2 is connected with the upper fixed shaft 21.

FIG. 3 again shows the feeding apparatus, in a view according to the arrow A in FIG. 2. For clearity's sake, the bearings of the various shafts and feed rollers, as well as the setting mechanism for the upper feed roller 2, have been left out.

Because the two feed rollers 2,3 are driven at the same speed, products consisting of several layers, such as folded or stacked products, can also be fed by the feeding apparatus 1 to a packing apparatus, with the feeding speed and the position being varied.

A particularly advantageous method according to the invention is characterized in that the products 4 are fed by means of a feed conveyor 5 at a specific speed $v_1$; the speed of the speed influencing means 2,3 is brought to the same speed $v_1$ as that of the products 4 fed on the feed conveyor 5; a product is fed between the speed influencing means 2,3 by the feed conveyor 5; the product is released by the feed conveyor 5; whereupon the product 4 is decelerated or accelerated by the speed influencing means 2,3 to a desired speed $v_2$ of the packing apparatus; the products 4 is simultaneously positioned relative to a packing material band 7; and the product 4 is released by the speed influencing means 2,3.

In this manner, the products 4 are placed on a packing material band 7 with an accurately settable distance in between. The packing material band 7 is subsequently folded around the products 4 and the folded parts are attached to one another in the direction of travel. Transversely to the direction of travel, the packing material band 7 between the products 7 is also secured and cut through to obtain separately packed products 4. This does not involve any waste of packing material in the direction of travel.

A particularly advantageous method according to the invention is characterized in that, after the products 4 is released by the feed conveyor 5, the position of the product 4 relative to the speed influencing means 2,3 is detected. This enables products 4 to be packed while the length of the products 4 fed is variable and without causing a loss of packing material, viewed in that direction of travel. This detection takes place for instance by means of an optical detecting means 10, arranged upstream of the feeding apparatus 1 above the conveying track of the products 4.

To also enable the feed of stacked products 4 which do not have the same dimensions in the direction of travel, it is desired that the mutual distance between the speed influencing means 2,3 is adjusted to the thickness of the product to be fed only after the detection of the position of the product and that they are moved apart again after the product has been released by the speed influencing means. The speed of the stacked products can thus be adjusted over a specific distance (length), with the thickness of the stacked products being almost equal.

We claim:

1. A method for the mutual repositioning of products, said products being fed at a specific speed and with a specific distance in between, and the mutual position of the products being changed by means of speed influencing means, characterized in that for the mutual repositioning of products (4) consisting of several layers, for adjusting the mutual position of graphic products in a packing apparatus, a speed influencing means (2, 3) is brought into engagement with the product (4) both at the top side and at the bottom side of the product (4), said two speed influencing means (2, 3) always being driven at the same speed relative to each other, and wherein the distance between the speed influencing means (2, 3) is infinitely variable without changing the speed of the speed influencing means (2, 3) relative to each other and without introducing a phase shift between the speed influencing means (2, 3).

2. A method according to claim 1, characterized in that during the varying of the speed, the mutual distance of the speed influencing means (2,3) is adjusted to the local thickness of the product (4) to be positioned between the speed influencing means (2,3).

3. A method according to claim 1, characterized in that the products (4) are fed at a specific speed ($v_1$) by means of a feed conveyor (5);

the speed of the speed influencing means (2,3) is brought to the same speed ($v_1$) as that of the products (4) fed on the feed conveyor (5);

a product (4) is fed by the feed conveyor (5) between the speed influencing means (2,3);

the product (4) is released by the feed conveyor (5);

whereupon the product (4) is decelerated or accelerated by the speed influencing means (2,3) to a desired speed ($v_2$) of the packing apparatus;

the product (4) is simultaneously positioned relative to a packing material band; and the product (4) is released by the speed influencing means (2,3).

4. A method according to claim 3, characterized in that after the product (4) is released by the feed conveyor (5), the position of the product (4) relative to the speed influencing means (2,3) is detected.

5. A method according to claim 1, characterized in that the mutual distance between the speed influencing means (2,3) is adjusted to the thickness of the product (4) to be positioned only after the detection of the position of the product (4), while after the release of the product (4) by the speed influencing means (2,3), said speed influencing means (2,3) are moved apart again.

6. A feeding apparatus for the mutual repositioning of products, comprising at least one speed influencing means, a transmission and a variable-speed motor, characterized in that for the mutual repositioning of products (4) consisting of several layers, for adjusting the mutual position of graphic products in a packing apparatus, a speed influencing means (2, 3) can be brought into engagement with the product (4) both at the top side and at the bottom side of the product (4), the two speed influencing means (2, 3) always having the same speed relative to each other and wherein the distance between the two speed influencing means (2, 3) is infinitely variables without changing the speed of the speed influencing means (2, 3) relative to each other and without involving a phase shift between the speed influencing means (2, 3).

7. A feeding apparatus according to claim 6, characterized in that the feeding apparatus comprises a detecting means (10) detecting the position of the product (4) to be positioned relative to the feed rollers (2,3).

8. A feeding apparatus according to claim 6, characterized in that the coupling (23) is of a type such that when the distance between the feed rollers (2,3) is being varied, the two feed rollers (2,3) keep the same angular speed relative to each other and such that no phase shift between the feed rollers occurs.

9. A feeding apparatus according to claim 6, characterized in that the speed influencing means are feed rollers (2, 3), the motor (11) driving two fixed shafts (20, 21) via the transmission (12-19), one feed roller (3) being directly mounted on one shaft (20) and the other feed roller (2) being connected with the other shaft (21) via a coupling (23).

10. A feeding apparatus according to claim 9, characterized in that the motor (11) drives the two fixed drive shafts (20,21) via a toothed belt (17) toothed on both sides.

* * * * *